US006166755A

United States Patent [19]

Obringer et al.

[11] Patent Number: 6,166,755

[45] Date of Patent: Dec. 26, 2000

[54] THERMAL TRANSFER RIBBON WITH PAPER LEADER AND TRAILER

[75] Inventors: Thomas J. Obringer, Vandalia; Thomas C. Miller, Jr., Dayton, both of Ohio

[73] Assignee: NCR Corporation, Dayton, Ohio

[21] Appl. No.: 09/179,797

[22] Filed: Oct. 27, 1998

[51] Int. Cl.[7] ..... B41J 33/14

[52] U.S. Cl. ..... 347/217

[58] Field of Search ..... 347/217; 400/237, 400/238, 239, 249, 703

[56] References Cited

U.S. PATENT DOCUMENTS

| | | | |
|---|---|---|---|
| 3,623,586 | 11/1971 | Shellabarger | 400/246 |
| 3,663,278 | 5/1972 | Blose et al. . | |
| 3,779,837 | 12/1973 | Zahn et al. . | |
| 3,856,228 | 12/1974 | Hosono et al. . | |
| 3,883,086 | 5/1975 | Zangenfeind et al. . | |
| 4,315,643 | 2/1982 | Tokunaga et al. . | |
| 4,403,224 | 9/1983 | Wirnowski . | |
| 4,432,625 | 2/1984 | Harvey . | |
| 4,463,034 | 7/1984 | Tokunaga et al. . | |
| 4,475,830 | 10/1984 | Schaefer | 400/238 |
| 4,609,422 | 9/1986 | Becking . | |
| 4,628,000 | 12/1986 | Talvalkar et al. . | |
| 4,687,701 | 8/1987 | Knirsch et al. | 400/241.1 |
| 4,707,395 | 11/1987 | Ueyama et al. | 428/195 |
| 4,777,079 | 10/1988 | Nagamoto et al. | 428/195 |
| 4,778,729 | 10/1988 | Mizobuchi | 428/195 |
| 4,923,749 | 5/1990 | Talvalkar | 428/195 |
| 4,975,332 | 12/1990 | Shini et al. | 205/52 |
| 4,983,446 | 1/1991 | Taniguchi et al. | 428/195 |
| 4,988,563 | 1/1991 | Wehr | 428/195 |
| 5,128,308 | 7/1992 | Talvalkar | 427/152 |
| 5,240,781 | 8/1993 | Obata et al. | 428/195 |
| 5,248,652 | 9/1993 | Talvalkar | 503/207 |
| 5,327,187 | 7/1994 | Slavitter . | |
| 5,348,348 | 9/1994 | Hanada et al. . | |
| 5,853,255 | 12/1998 | Soshi et al. | 400/238 |
| 6,022,678 | 2/2000 | Makino | 430/501 |
| 6,031,021 | 2/2000 | Kenny et al. | 523/161 |

FOREIGN PATENT DOCUMENTS

| | | |
|---|---|---|
| 0595265 | 5/1994 | European Pat. Off. . |
| 1167396 | 10/1969 | United Kingdom . |

*Primary Examiner*—N. Le
*Assistant Examiner*—K. Feggins
*Attorney, Agent, or Firm*—Millen White Zelano & Branigan PC

[57] ABSTRACT

Thermal transfer ribbons having a polyester substrate which employ paper leaders and/or paper trailers with printed indicia thereon such as marking which identify the thermal transfer ribbon and instructions for its use. The paper having a stiffness greater than the polyester substrate can be used as a leader and/or trailer for the thermal transfer ribbons. The paper leaders and trailers can be colored to provide further identification of the thermal transfer ribbons.

11 Claims, No Drawings

THERMAL TRANSFER RIBBON WITH PAPER LEADER AND TRAILER

FIELD OF THE INVENTION

The present invention relates to thermal transfer printing wherein images are formed on a receiving substrate (paper) by heating extremely precise areas of a print ribbon with thin film resistors. Heating of the localized areas causes transfer of ink from the ribbon to a receiving substrate.

More particularly, the present invention is directed to thermal transfer ribbons having more versatile leaders and trailers.

BACKGROUND OF THE INVENTION

Thermal transfer printing has displaced impact printing in many applications due to advantages such as relatively low noise levels during the printing operation. Thermal transfer printing is widely used in special applications such as in the printing of machine readable bar codes and magnetic alphanumeric characters. The thermal transfer process provides great flexibility in generating images and allows for broad variations in style, size and color of the printed image. Representative documentation in the area of thermal printing includes the following patents:

- U.S. Pat. No. 3,663,278, issued to J. H. Blose et al. on May 16, 1972;
- U.S. Pat. No. 4,315,643, issued to Y. Tokunaga et al. on Feb. 16, 1982;
- U.S. Pat. No. 4,403,224, issued to R. C. Winowski on Sep. 6, 1983;
- U.S. Pat. No. 4,463,034, issued to Y. Tokunaga et al. on Jul. 31, 1984;
- U.S. Pat. No. 4,628,000, issued to S. G. Talvalkar et al. on Dec. 9, 1986;
- U.S. Pat. No. 4,687,701, issued to K. Knirsch et al. on Aug. 18, 1987;
- U.S. Pat. No. 4,707,395, issued to S. Ueyama et al., on Nov. 17, 1987;
- U.S. Pat. No. 4,777,079, issued to M. Nagamoto, et al. on Oct. 11, 1988;
- U.S. Pat. No. 4,778,729, issued to A. Mizobuchi on Oct. 18, 1988;
- U.S. Pat. No. 4,923,749, issued to Talvalkar on May 8, 1990;
- U.S. Pat. No. 4,975,332, issued to Shini et al. on Dec. 4, 1990;
- U.S. Pat. No. 4,983,446, issued to Taniguchi et al. on Jan. 8, 1991;
- U.S. Pat. No. 4,988,563, issued to Wehr on Jan. 29, 1991;
- U.S. Pat. Nos. 5,128,308 and 5,248,652, issued to Talvalkar; and
- U.S. Pat. No. 5,240,781, issued to Obatta et al.

Most thermal transfer ribbons employ a synthetic resin as a substrate. Polyethylene terephthalate (PET) polyester is commonly used. The functional layer which transfers ink, also referred to as the thermal transfer layer, is deposited on one side of the substrate and a protective silicone backcoat is typically deposited on the other side of the polyethylene terephthalate substrate to simplify passage under a thermal print head.

Leaders which are stiffer than the thermal transfer ribbons are attached to the beginning of the ribbon to simplify installation into the thermal transfer printers. With the use of a leader, the operator who threads the thermal transfer ribbon into the thermal transfer printer need not touch the ink layer. This helps keep the operator and the equipment clean and protects the ink layer at the beginning of the thermal transfer ribbon from damage during installation and shipping.

Trailers are attached to the end of thermal transfer ribbons to signal the end of the ribbon to sensors within the thermal transfer printer and also serve as the point of attachment of the ribbon to the spool on which it is stored.

The materials used for leaders and trailers of thermal transfer ribbons typically are identical to the synthetic resin substrate of the thermal transfer ribbon and so typically are polyethylene terephthalate (PET) polyester films of a thickness greater than the polyester ribbon substrate (about 1 to 1.5 mil) so as to provide greater stiffness. These leaders and trailers can be adhered to the polyester ribbon substrate with conventional pressure sensitive adhesive tape. The trailer can also be attached to the spool upon which the thermal transfer ribbon is stored with conventional pressure sensitive adhesive tape.

One disadvantage of the polyester films used as leaders and trailers is that they do not easily accept print and require complex procedures and printing operations on press to mark them. Therefore, once separated from accompanying materials and packaging, spools of thermal transfer ribbons are difficult to distinguish or identify without marking the spool itself. Due to the limited surface area available for printing on the spool, limited information can be provided. For example, it is not practical to provide instructions and diagrams on threading the thermal transfer ribbon into a thermal transfer printer on the spool. In addition, when a ribbon has been expended, the packaging and materials which accompany the ribbon typically have been disposed of and the operator has little direction with respect to replacement of the ribbon when needed.

The leader and trailer have simple functions and there are many materials which will meet the physical property requirements necessary for the leaders and trailers to perform theses simple functions. For example, U.S. Pat. No. 3,856,228, issued to Hosono et al. on Dec. 24, 1974, describes the use of a leader for magnetic recording tape at column 3, lines 5–8, where the only requirement for the material used is that it have a rigidity high enough to thread through a predetermined passage. Despite their simple functions, the use of materials for the leaders and trailers distinct from the ribbon substrate raises concerns of misalignment with the ribbon substrate, separation due to poor adhesion to the ribbon substrate, stretching during manufacture or use which is mismatched with the ribbon substrate and friction, tension or drag force during manufacture or use which is mismatched with the ribbon substrate. Therefore, using materials for the leader or trailer distinct from the ribbon substrate is generally not preferred and is typically not practiced.

For example, U.S. Pat. No. 4,609,422, issued to Becking on Sep. 2, 1986, describes an apparatus for stuffing preinked printer ribbons into a ribbon cartridge wherein the leader is welded to the print ribbon. Such equipment favors the use of similar materials for the leader and print ribbon to provide an effective weld. In addition, where dissimilar materials are used for the leaders and trailers (foil leaders and trailers) for certain typewriters and impact printers, steps are taken to reduce the possibility of misalignment and other problems. In U.S. Pat. No. 4,475,830, Schaefer describes the preparation of print ribbons with foil leaders and trailers without splicing wherein foil composites are laminated directly to the print ribbon substrate. These laminated portions become the leaders and trailers when the ribbon is slit (see column 5, lines 13–20 and 62–63). Since the ribbon substrate is part of the laminate which comprises the leaders and trailers, some of the problems associated with the use of dissimilar materials are avoided.

Uniting bands that accept print have been used in the art of film processing methods, which is non-analogous to the art of print ribbons. In these methods a series of exposed films are attached by uniting bands, referred to as "leaders", to form a continuous web for film processing equipment and methods. U.S. Pat. No. 3,779,837, issued to Zahn et al. on Dec. 18, 1973, discloses the use of an encoding device to apply numbers to the uniting bands and associated envelopes at column 8, lines 47–51. These uniting bands ("leaders") comprise paper and are printed on for purposes of identification. Since the exposed film typically has a paperbacking to shield the film and aid in handling of the film, the use of paper for the uniting bands does not present the problems associated with the use of a material for the leader or trailer distinct from the ribbon substrate. Examples of references which describe the use of printable uniting bands ("leaders") for exposed film are as follows: U.S. Pat. No. 4,432,625, issued to Harvey on Feb. 21, 1984 (see column 3, lines 50–57); and U.S. Pat. No. 3,883,086, issued to Zangenfeind et al. on May 13, 1975 (see column 3, lines 64–68).

Short paper leaders and trailers are described as suitable for film units which contain two polyester films in sheet form in U.S. Pat. No. 5,327,187 (see column 4, lines 31–34). These paper leaders and trailers are attached directly to polyester films without paper backing. The polyester films are part of a complex film laminate and are not in ribbon form consistent with print ribbons.

SUMMARY OF THE INVENTION

It has been discovered through this invention that leaders and trailers comprised of paper can be used for thermal transfer ribbons having a polyester substrate without misalignment, poor adhesion (separation) or mismatched stretching, friction or drag force during manufacture or use.

It is an object of the present invention to provide a leader and trailer for thermal transfer ribbons with polyester substrates which can be easily printed on.

It is another object of the present invention to provide a leader and trailer for thermal transfer ribbons with polyester substrates which can be printed on by ink jet printing, impact printing or thermal printing.

It is a further object of the present invention to provide a paper leader and trailer for thermal transfer ribbons having a polyester substrate which contains printed indicia thereon.

It is yet a further object of the present invention to provide a thermal transfer ribbon having a polyester substrate with a leader and trailer of colored paper.

These and other objects and advantages of the present invention will become apparent and further understood from the detailed description and claims which follow.

The above objects are achieved through the discovery that paper having a stiffness greater than the polyester ribbon substrate (about 10–40 lb) can be used as a leader and/or trailer for thermal transfer ribbons.

There is provided by this invention a thermal transfer ribbon of a width in the range of 1 to 10 inches which is wound on a spool, which comprises a polyester substrate and a thermal transfer layer (functional layer) positioned thereon with a paper leader and/or paper trailer. Both the paper leader and paper trailer have printed indicia thereon.

The paper leader is attached to the beginning of the polyester substrate and is of equal width to the polyester substrate. The paper leader preferably is of a length suitable for threading the thermal transfer print ribbon into a thermal transfer printer and has a stiffness greater than the polyester substrate.

The paper trailer is attached to the end of the polyester substrate and also is of equal width to the polyester substrate. The opposite end of the paper trailer is attached to the spool on which the ribbon is stored and is preferably of a length suitable for detection of the end of said thermal transfer ribbon by sensors in thermal transfer printer. The paper trailer need not have a stiffness greater than the synthetic polymer substrate but typically is made of the same material as the leader.

In preferred embodiments, the printed indicia on the paper leader and paper trailer provides information which identifies:

a) the thermal transfer ribbon;

b) the source of the thermal transfer ribbon;

c) how to install the thermal transfer ribbon in a thermal transfer printer;

d) how to use the thermal transfer ribbon in a thermal transfer printer; and/or e) how to replace the thermal transfer ribbon when installed in a thermal transfer printer.

DETAILED DESCRIPTION

The thermal transfer ribbon of the present invention comprises a polyester substrate, preferably a polyethylene terephthalate (PET) polyester substrate, with a thermal transfer layer (functional layer) positioned thereon. The thickness of the polyester substrate can vary widely and is preferably from 3 to 50 microns. Films of about 4.5 micron thickness are most preferred. The polyester substrate defines the width of the thermal transfer ribbon, which falls within the range of 1 to 10 inches. Another preferred polyester resin substrate is that comprised of polyethylene naphthalate polyester. The polyester substrates have high tensile strength and are easy to handle during preparation and use of the thermal transfer ribbon. The polyester substrates provide these properties at a minimum thickness and low heat resistance to prolong the life of the heating elements within thermal print heads. To minimize print head wear, the polyester substrates preferably have a silicone resin backcoating comprised of high molecular weight polydimethylsiloxanes such as those available from General Electric Company and Dow Corning Corporation.

The paper leader and/or paper trailer are preferably attached directly to the polyester substrate by conventional means, preferably with the use of pressure sensitive adhesive tape. The paper leader is stiffer than the polyester substrate and typically has a thickness of 1 to 4 times the thickness of the ribbon substrate. Papers of a weight within the range of 10–40 lbs. are preferred. The paper trailer does not have such requirements, but comprises the same paper as the paper leader in preferred embodiments.

Certain preferred embodiments include paper leaders and trailers with a color other than white. These colored papers can be used to code information regarding the thermal transfer ribbon such as whether the composition of the binder comprises wax alone, resin alone or a mixture of wax and resin. Where the trailer and leader are of the same color, the operator can identify a replacement ribbon quickly by matching the color of the trailer on the spent ribbon with the color of a leader on a replacement ribbon.

The paper leaders and trailers can be applied to the polyester substrates by conventional methods which typically comprise inserting a wide sheet of leader/trailer material at desired segments (ribbon lengths) into a jumbo roll of polyester ribbon coated with the thermal transfer layer. The leader/trailer is typically taped between segments of the polyester ribbon from the jumbo roll before it is sent to the splitter, where it is split into desired widths of 1–10 inches. The inserted leader/trailer material is split with the polyester ribbon such that its width is equal to that of the polyester substrate. The split leader/trailer material is then cut to provide a trailer for one segment of the polyester ribbon and leader for the other segment of polyester ribbon to which it is attached. The trailers are attached to spools upon which the polyester ribbons are wound until the next section of leader/trailer material is split and cut to form the leaders of the wound polyester ribbons.

The paper leader can vary widely in length but should be sufficiently long for threading into a thermal transfer printer. At a minimum, the paper leader should surround the thermal transfer ribbon wound on a spool.

The paper trailer can also vary widely in length and preferably is sufficiently long to permit detection of the end of said thermal transfer ribbon by sensors in a thermal transfer printer. The paper trailer is typically perforated at a portion thereof to signal the end of the ribbon. At a minimum, the paper trailer must be sufficiently long to permit attachment to the spool which holds the thermal transfer ribbon. This requires that the paper trailer provide a surface for the pressure sensitive adhesive tape that bonds the paper trailer to the ribbon substrate and also for the pressure sensitive adhesive tape that bonds the paper trailer to the spool.

The printed indicia on the paper trailer and leader are typically applied prior to attachment to the ribbon substrate and splitting. Printing can be applied by any conventional means such as impact, thermal transfer, ink jet and flexographic printing as well as thermal printing. Where the paper leader and trailer comprise thermal paper, the printed indicia can be applied after the paper leader and trailer are attached to polyester ribbon substrate. Ink jet printing can also be used to apply printed indicia to the paper leader or trailer after they are attached to the polyester ribbon substrate.

Printed indicia applied to the paper leader and trailer which is preferred comprises that which identifies the thermal transfer ribbon, such as a trade name or trademark and that which identifies the source of the thermal transfer ribbon, such as the manufacturers name or trademark. Other preferred printed indicia include instructions and diagrams on how to install, use and replace the thermal transfer ribbon in thermal transfer printers.

It is noted that while the use of both a paper leader and paper trailer is discussed above and is preferred, the present invention includes embodiments of thermal transfer layers wherein only a paper leader or paper trailer is used.

The paper substrate provides additional advantages over polyester leaders and trailers in that they typically are easier to remove from thermal transfer printers, particularly where tension on the ribbon is high. In addition, the paper leaders and trailers used are easier to recycle.

The thermal transfer layers of the thermal transfer ribbons of this invention preferably are comprised of wax, a sensible material, and a thermoplastic resin binder. The thermal transfer layer (functional layer) preferably has a softening point within the range of about 50° C. to 250° C. which enables transfer at normal print head energies which range from about 100° C. to 250° C. and more typically from about 100° C. to 150° C. The coat weight of the thermal transfer layer typically ranges from 1.9 to 4.3 g/m$^2$.

The thermal transfer layers of the thermal transfer ribbons of this invention typically comprise wax as a main dry component. Suitable waxes provide temperature sensitivity and flexibility. Examples include natural waxes such as carnauba wax, rice bran wax, bees wax, lanolin, candelilla wax, motan wax and ceresine wax; petroleum waxes such as paraffin wax and microcrystalline waxes; synthetic hydrocarbon waxes such as low molecular weight polyethylene and Fisher-Tropsch wax; higher fatty acids such as lauric acid, myristic acid, palmitic acid, stearic acid and behenic acid; higher aliphatic alcohol such as stearyl alcohol and esters such as sucrose fatty acid esters, sorbitane fatty acid esters and amides. The wax-like substances have a melting point less than 200° C. and preferably from 40° C. to 130° C. The amount of wax in the thermal transfer layer is preferably above 25 weight percent and most preferably ranges from 25 to 85 percent by weight, based on the weight of dry ingredients.

Although waxes can be used as the sole binder component, the thermal transfer layers of the thermal transfer ribbons of this invention typically also comprise a binder resin. Suitable binder resins are those conventionally used in thermal transfer layers. These binder resins include thermoplastic resins and reactive resins such as epoxy resins.

Suitable thermoplastic binder resins include those described in U.S. Pat. No. 5,240,781 and U.S. Pat. No. 5,348,348 which have a melting point of less than 300° C., preferably from 100° C. to 225° C. Examples of suitable thermoplastic resins include polyvinyl chloride, polyvinyl acetate, vinyl chloride-vinyl acetate copolymers, polyethylene, polypropylene, polyacetal, ethylene-vinyl acetate copolymers, ethylene alkyl (meth)acrylate copolymers, ethylene-ethyl acetate copolymers, polystyrene, styrene copolymers, polyamide, ethylcellulose, epoxy resin, xylene resin, ketone resin, petroleum resin, terpene resin, polyurethane resin, polyvinyl butyryl, styrene-butadiene rubber, saturated polyesters, styrenealkyl (meth) acrylate copolymer, ethylene alkyl (meth)acrylate copolymers. Suitable saturated polyesters are further described in U.S. Pat. No. 4,983,446. Thermoplastic resins are preferably used in an amount of from 2 to 35 weight percent based on the total dry ingredients of the thermal transfer layer.

Suitable reactive binder components include epoxy resins and a polymerization initiator (crosslinker). Suitable epoxy resins include those that have at least two oxirane groups such as epoxy novolak resins obtained by reacting epichlorohydrin with phenol/formaldehyde condensates or cresol/formaldehyde condensates. Another preferred epoxy resin is polyglycidyl ether polymers obtained by reaction of epichlorohydrin with a polyhydroxy monomer such as 1,4 butanediol. A specific example of suitable epoxy novolak resin is Epon 164 available from Shell Chemical Company. A specific example of the polyglycidyl ether is available from Ciba-Geigy Corporation under the trade name Araldite® GT 7013. The epoxy resins are preferably employed with a crosslinker which activates upon exposure to the heat from a thermal print head. Preferred crosslinkers include polyamines with at least two primary or secondary amine groups. Examples being Epi-cure P101 and Ancamine 2014FG available from Shell Chemical Company and Air Products, respectively. Accelerators such as triglycidylisocyanurate can be used with the crosslinker to accelerate the reaction. When used, the epoxy resins typically comprise more than 25 weight percent of the thermal transfer layer based on dry components in view of their low viscosity. Waxes are typically not necessary when reactive epoxy resins form the binder. Thermoplastic resins may comprise the only binder component for selected thermal transfer layers where at least a portion of the resins are of low molecular weight.

The thermal transfer layers also contain a sensible material which is capable of being sensed visually, by optical means, by magnetic means, by electroconductive means or by photoelectric means. The sensible material is typically a coloring agent, such as a dye or pigment, or magnetic particles. Any coloring agent used in conventional ink ribbons is suitable, including carbon black and a variety of organic and inorganic coloring pigments and dyes, examples of which include phthalocyanine dyes, fluorescent naphthalimide dyes and others such as cadmium, primrose, chrome yellow, ultra marine blue, titanium dioxide, zinc oxide, iron oxide, cobalt oxide, nickel oxide, etc. Examples of sensible materials include those described in U.S. Pat. No. 3,663,278 and U.S. Pat. No. 4,923,749. Reactive dyes such as leuco dyes are also suitable. In the case of magnetic thermal printing, the thermal transfer layer includes a magnetic pigment or particles for use in imaging to enable machine reading of the characters. This provides the advantage of encoding or imaging the substrate with a magnetic signal inducible ink. The sensible material is typically used in an amount of from 1 to 50 parts by weight to the total dry ingredients of the thermal transfer layer.

The thermal transfer layers may also contain conventional additives such as plasticizers, viscosity modifiers, tackifiers, silicone resins etc.

Suitable thermal transfer layers include those that contain a mixture of waxes such as paraffin wax, carnauba wax and hydrocarbon wax. With mixtures of waxes, a thermoplastic resin binder is typically also employed.

The coating formulations that provide the thermal transfer layers can be made by conventional processes such as by mixing a hydrocarbon wax, paraffin wax, carnauba wax and thermoplastic polymer resin for about 15 minutes at a temperature of about 190° F. in water or organic solvent, after which carbon black and black ink are added and ground in an attritor at about 140° F. to 160° F. for about two hours.

The paper leaders and trailers are attached to the polyester substrate after the thermal transfer layer is applied and after the silicone resin backcoat is applied. It may be desirable to remove a portion of the silicone resin backcoat and/or thermal transfer layer from the polyester substrate for the pressure sensitive adhesive to bond directly to the polyester substrate.

The thermal transfer layers can be applied to the ribbon substrate from a solution, dispersion or emulsion of the components using conventional techniques and equipment such as a Meyer Rod or similar wire round doctor bar set up on a conventional coating machine to provide the coating weights described above. A temperature of about 160° F. is maintained during the entire coating process. After the coating formulation is applied, it is optionally passed through a dryer at an elevated temperature to ensure drying and adherence of the thermal transfer layer to the substrate.

The thermal transfer ribbons of the present invention provide all the advantages of thermal printing. When the thermal transfer ribbon is exposed to the heating elements of the thermal print head, the thermal transfer layer softens and transfers from the ribbon to the receiving substrate.

Without further elaboration, it is believed that one skilled in the art can, using the preceding description, utilize the present invention to its fullest extent.

The entire disclosure of all applications, patents and publications, cited above and below, are hereby incorporated by reference.

What is claimed is:

1. A thermal transfer ribbon of a width in the range of 1 to 10 inches wound on a spool, said thermal transfer ribbon comprising a polyester substrate with a thermal transfer layer positioned thereon and either a) a paper leader attached to the beginning of said polyester substrate for threading the thermal transfer print ribbon into a thermal transfer printer, said paper leader having a width equal to the polyester substrate and a stiffness greater than the polyester substrate and having printed indicia thereon;

b) a paper trailer attached to the end of said polyester substrate and attached to said spool for the detection of the end of said thermal transfer ribbon, said paper trailer having a width equal to the polyester substrate and having printed indicia thereon; or c) both a paper leader of a) and a paper trailer of b).

2. A thermal transfer ribbon as in claim 1 wherein the polyester substrate is polyethylene terephthalate and the printed indicia on the paper leader and paper trailer provides information which identifies:

a) said thermal transfer ribbon;

b) the source of said thermal transfer ribbon;

c) how to install said thermal transfer ribbon in a thermal transfer printer;

d) how to use said thermal transfer ribbon in a thermal transfer printer;

e) how to replace said thermal transfer ribbon when installed in a thermal transfer printer; or f) a combination of a)–e).

3. A thermal transfer ribbon as in claim 1 wherein the paper leader is the same color as the paper trailer.

4. A thermal transfer ribbon as in claim 3 wherein the paper leader and paper trailer are a color other than white.

5. A thermal transfer ribbon as in claim 4 wherein the color of the paper leader and paper trailer identifies the components within the binder of the thermal transfer layer as comprised of wax, thermoplastic resin or a blend of wax and thermoplastic resin.

6. A thermal transfer ribbon as in claim 1 wherein the paper leader and paper trailer comprise thermal paper.

7. A thermal transfer ribbon as in claim 1 wherein the printed indicia on the paper leader and paper trailer is applied after they are attached to the polyester substrate.

8. A thermal transfer ribbon as in claim 1 wherein at least a portion of the paper trailer is perforated to signal the end of the ribbon to a sensor in a thermal transfer printer.

9. A thermal transfer ribbon as in claim 1 wherein the polyester substrate has a silicone resin backcoat.

10. A thermal transfer ribbon of a width in the range of 1 to 9 inches wound on a spool, said thermal transfer ribbon comprising a polyethylene terephthalate polyester substrate with a thermal transfer layer position thereon and either a) a 10–40 lb paper leader attached to the beginning of said polyethylene terephthalate polyester substrate for threading the thermal transfer print ribbon into a thermal transfer printer, said paper leader having a width equal to the polyethylene terephthalate polyester substrate and a stiffness greater than the polyethylene terephthalate polyester resin substrate and having printed indicia thereon; and b) a 10–40 lb paper trailer attached to the end of said polyethylene terephthalate polyester substrate and attached to said spool for the detection of the end of said thermal transfer ribbon, said paper trailer having a width equal to the polyethylene terephthalate polyester substrate and having printed indicia thereon; or c) both a paper leader of a) and a paper trailer of b), wherein the printed indicia on the paper leader and paper trailer provides information which identifies:
   a) said thermal transfer ribbon;
   b) the source of said thermal transfer ribbon;
   c) how to install said thermal transfer ribbon in a thermal transfer printer;
   d) how to use said thermal transfer ribbon in a thermal transfer printer;
   e) how to replace said thermal transfer ribbon when installed in a thermal transfer printer; or
   f) a combination of a)–e).

11. A thermal transfer ribbon as in claim 10 wherein the polyethylene terephthalate polyester substrate has a silicone resin backcoat.

* * * * *

UNITED STATES PATENT AND TRADEMARK OFFICE

CERTIFICATE OF CORRECTION

PATENT NO. : 6,166,755
DATED : December 26, 2000
INVENTOR(S) : Thomas J. Obringer et al.

It is certified that error appears in the above-identified patent and that said Letters Patent is hereby corrected as shown below:

Column 8,
Line 51, after "to" change "9 inches" to -- 10 inches --.

Signed and Sealed this

Tenth Day of December, 2002

JAMES E. ROGAN
*Director of the United States Patent and Trademark Office*